United States Patent [19]

Schmidt et al.

[11] 4,321,877

[45] Mar. 30, 1982

[54] GASIFICATION FURNACE

[75] Inventors: H. Dean Schmidt, Sylvania; Peter M. Eckstrom, Toledo, both of Ohio

[73] Assignee: Midland-Ross Corporation, Cleveland, Ohio

[21] Appl. No.: 106,334

[22] Filed: Dec. 21, 1979

Related U.S. Application Data

[62] Division of Ser. No. 945,248, Sep. 25, 1978, abandoned.

[51] Int. Cl.[3] ..... F23N 5/18

[52] U.S. Cl. ..... 110/186; 110/108; 110/165 R; 110/255; 110/256; 406/70

[58] Field of Search ..... 110/102, 186, 189, 190, 110/229, 101 R, 101 A, 256, 165 R, 105, 108, 255; 48/197, 203, 209, 206; 406/70

[56] References Cited

U.S. PATENT DOCUMENTS

| | | | |
|---|---|---|---|
| 1,979,176 | 10/1934 | Schicht | 406/70 |
| 2,151,574 | 3/1939 | Ward | 110/108 X |
| 2,175,610 | 10/1939 | Linder | 48/203 |
| 2,923,260 | 2/1960 | Rummel | 48/206 X |
| 3,402,684 | 9/1968 | Gradischer et al. | 110/102 |
| 3,847,296 | 11/1974 | Stockman | 110/165 R |
| 3,865,053 | 2/1975 | Kolze et al. | 110/186 |

*Primary Examiner*—Edward G. Favors
*Attorney, Agent, or Firm*—Richard A. Negin

[57] ABSTRACT

A continuous gasification furnace and method of operation. The charge is fed into the furnace chamber between two rolls at least one of which is driven. The furnace chamber can be sealed from the ambient atmosphere. The bed of the furnace contains three zones from top to bottom, these zones are; a volatilization zone, a char reaction zone and an ash zone. Additionally, there can be a drying zone above the volatilization zone. Fuel, air, and steam enter the lower portion of the furnace through strategically located inlet ports. Fuel is used to start up the burning bed while carefully controlled steam to air ratio is used during continuous operation of the furnace. Simultaneously controlled steam cooling effects and exothermic reactions occur in the char reaction zone whereby all or controlled amounts of the oxygen is consumed so that pyrolysis can occur in the volatilization zone without the danger of combustion in that zone or combustion of the fumes leaving the bed. The ash is discharged into an ash hopper designed so that the ash within the hopper supports the charge bed.

7 Claims, 3 Drawing Figures

GASIFICATION FURNACE

This application is a division of application Ser. No. 945,248, filed Sept. 25, 1978, now abandoned.

BACKGROUND OF THE INVENTION

This invention is an improved continuous furnace and method of operation and is particularly applicable to continuous gasification of waste material. The furnace of the present invention has an improved feed means, discharge means, means to introduce steam and air and an improved method of operation.

Feed systems of furnaces, and particularly continuous furnaces, do not have the ability to continuously compact feed materials such as waste. Presently, when waste material must be compacted before being charged into a furnace, a compacting ram is used. It is difficult to use a compacting ram in a continuous feed stream to a furnace. Complicated sealing means must be provided when a compacting ram is placed in the feed path of a furnace where it is desired to keep a seal between it and the furnace.

The use of steam in furnaces is well known. Steam is used for two purposes; the first is as a means for cooling and the second is as a means to promote more efficient combustion of the fuel or charge to be burned. When steam, air and carbon are present in the furnace mix at elevated temperatures, an endothermic reaction proceeds resulting in highly combustible reaction products including hydrogen and carbon monoxide which burn in the presence of oxygen creating intense heat which in turn promotes more efficient burning of the fuel or charge to be burned.

Furnaces are known which take advantage of the endothermic reaction of the steam feed as a means to cool or the exothermic reaction of the burning of the highly combustible reaction products as a means for more efficient combustion, or both the steam feed cooling and the exothermic reaction. Both effects have been used in furnaces by using separate steam inputs at different places within furnaces to accomplish specific purposes.

Furnaces using steam have had combustion of fuel or other material as their sole purpose while the present invention concerns gasification of waste material. Where steam and air have been used in furnaces, a continuing concern has been the methods of injecting or feeding both the steam and the air into the furnaces. This concern is evidence of the desire to control either the endothermic reaction of the steam or the exothermic reaction of the steam in the furnace and to obtain a uniform air and steam mixture.

In continuous sealed furnaces, mechanical devices such as double tipping valves are used to sealingly discharge ash from the furnace. Such devices usually have double seals to allow a seal to be maintained during the discharge. Another mechanical device is a cone which eccentrically rotates above the discharge port of the furnace. The cone supports the charge bed and agitates it as it rotates with the ash falling into a sealed ash hopper from between the cone and the furnace wall. It would be desireable to eliminate moving mechanical ash discharge devices from the body of the furnace and from immediate area of the discharge port so as to allow repair and replacement without significantly affecting furnace operation.

SUMMARY OF THE INVENTION

The present invention is an improved continuous furnace and method of operation and is particularly applicable to continuous gasification of waste material. The furnace of the present invention has an improved feed means, discharge means, means to introduce steam and air and an improved method of operation.

The furnace has a sealed feed means with the charge being fed into the furnace by driven roller means. Air and steam are fed through ports in the lower portion of the furnace. The air and the steam ports are strategically located for maximum mixing within the ash bed. Steam and air are fed into the furnace and their ratio is controlled so that endothermic reaction of the steam and exothermic reactions of oxygen and waste occur simultaneously in a char reaction zone where all or contolled amounts of the oxygen is consumed. Pyrolysis occurs in a volatilization zone above the char reaction zone. The ash is discharged into an ash hopper which is sized so that the ash itself supports the charge within the furnace.

It is the general object of the present invention to provide an improved gasification furnace and method of operation. It is an object of the present invention to have a continuous feed system which is sealed from the atmosphere. The feed system should have the ability to feed with as great a seal as possible and compact material of loose density that is being charged to the furnace. More specifically, it is an object of the present invention to charge the feed to the furnace between at least two rollers, at least one of which is driven, It is a further object of the present invention to have the rollers located within the feed stream to the furnace and have the waste being fed through the bite of the rollers to act as a furnace sealing means.

It is an object of the present invention to provide ports for steam and air which are strategically located so as to provide maximum mixing and uniform temperature ranges in horizontal planes as the furnace is ascended.

It is another object of this invention to control the exothermic reactions of oxygen and waste and endothermic reaction of the steam in the char reaction zone of the furnace. A further object of the present invention is that pyrolysis takes place in a volatilization layer adjacent to the char reaction zone within the furnace. This is possible because all of the oxygen or controlled amounts of oxygen in the furace would have been consumed in the char reaction zone. It is the object of the present invention to relate the flow of air and steam to the weight of a charge having a known heat value and composition. Another object of the present invention is to control the air to steam ratio by relating it to variations in the temperature measured in the char reaction zone of the furnace. It is a further object of the present invention to provide a gasification furnace operating so that fumes coming off have a minimum of particulate matter.

It is an object of the present invention to continuously discharge ash without a movable mechanical device in intimate contact with the discharge port of the furnace. Finally, it is an object of the present invention to have the ash hopper designed so that the ash in the hopper will support the charge bed and not some mechanical support within the furnace or attached to the discharge port.

It is the object of the present invention to obtain one or more of the objects set forth above. These and other objects and advantages of this invention would become apparent to those skilled in the art from the following specification and claims, reference being had to the attached drawings.

DESCRIPTION OF THE PREFERRED EMBODIMENTS

Structure

Figure 1:
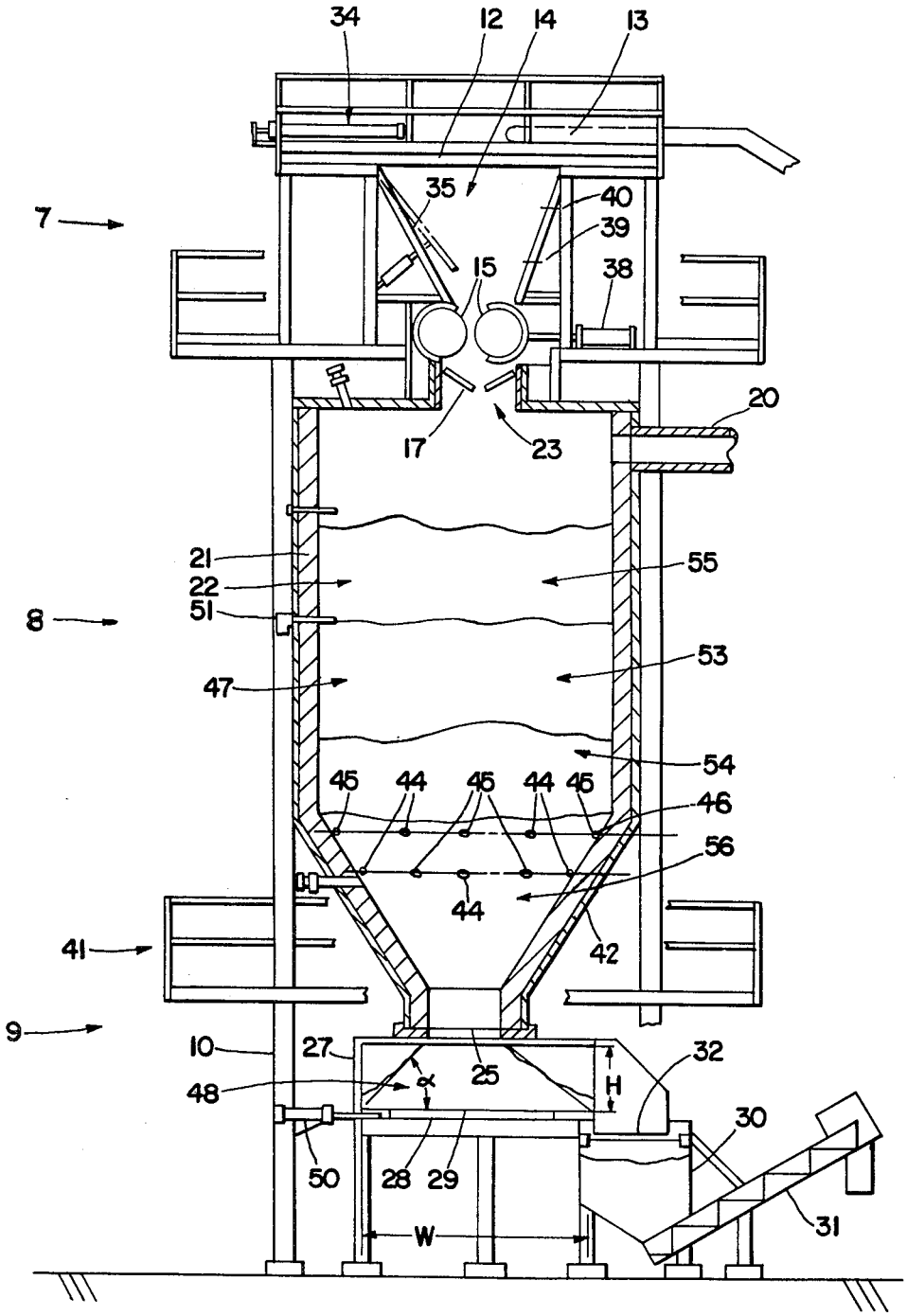
FIG. 1 is a sectional view of the furnace of the present invention.

The present invention will be understood by those skilled in the art by reference to FIG. 1 which is a sectional view of a preferred embodiment of the furnace of the present invention, e.g., a vertical continuous gasification furnace. The furnace of FIG. 1 is used to illustrate the present invention and should not limit the type of furnace or the furnace application of the present invention.

The basic furnace of the present invention can be divided into three portions; a feed portion 7, a body portion 8, and a discharge portion 9. The three portions of the furnace are supported by a superstructure 10.

Feed Portion

The feed portion 7 of the furnace has a charge entrance 12 and the means to feed charge into the charge entrance 12 such as a conveyor belt 13. There is a charge hopper 14 adjacent to the charge entrance 12 and at least two rollers 15 between the hopper 14 and the body portion 8 of the furnace. Between the rollers 15 and the body portion 8 can be trapdoors 17, or a sealing gate or other suitable sealing means.

The conveyor belt 13 mounted on the superstructure 10 is located so as to bring the charge to charge entrance 12. Because the furnace is to be sealed from the ambient atmosphere a means is provided to seal charge entrance 12. One such means is an entrance gate 34 which can be closed when no charge is being fed by conveyor belt 13, thereby forming a seal at the charge entrance 12 of the furnace. The hopper 14 receives the charge which comes through the charge entrance 12. To prevent bridging of the charge in the hopper 14, a shaking means such as movable wall 35 is provided. The charge moves from the hopper through at least two rollers 15 before being fed through the furnace entrance 23 and then into the furnace chamber 22. There is a means 38 to control the distance between the two rollers 15. The distance between the two rollers 15 can vary so that the rollers are virtually touching and charge fed through them would be compressed as it passes into the furnace or they can be separated so that the charge can freely fall from the hopper 14 into the furnace chamber 22. Preferably there are two rollers with at least one of the rollers driven so that the charge within the hopper 14 can be pulled into the furnace chamber 22 by the action of the driven roller 15. Between the rollers 15 and the furnace chamber 22 is furnace entrance 23 and a means to seal the furnace entrance such as a sealing gate or at least one trapdoor 17. Preferably, the trapdoor 19 is composed of two doors one on each side of the furnace entrance which close together like bombay doors to form a further seal of the furnace chamber 22 from the feed portion 7 of the furnace.

The rate at which the charge is fed into the furnace chamber 22 from between the rollers 15 can be controlled. A preset feed rate from the conveyor belt 13 is based on the weight of charge necessary for proper operation of the furnace. Additionally, there are means to sense the level charge in the charge hopper 14, such as lower level detector 39 and upper level detector 40 which are mounted on the wall of charge hopper 14. These detectors can signal to increase or decrease the conveyor belt 13 feed rate. The rate at which the conveyor belt 13 feeds charge into charge hopper 14 can vary due to density changes in the charge.

Body Portion

The body portion 8 of the furnace has a suitable furnace wall 21 made of supporting and refractory material known in the art. Enclosed within the furnace wall 21 is a furnace chamber 22. Charge from feed portion 7 enters the furnace chamber 22 through furnace entrance 23. Gases occurring within the furnace egress through a fume vent 20 passing through the furnace wall 21 in the upper part of the furnace chamber 22. Discharge end 41 tapers down to the discharge exit 25 and preferably has a conical section 42. Fuel and air inlet means and steam inlet means are strategically located within the conical section 42 of the discharge end 41 to achieve a complete and immediate mixture of air and steam. The furnace chamber 22 is sealed from the ambient atmosphere.

Figure 2:
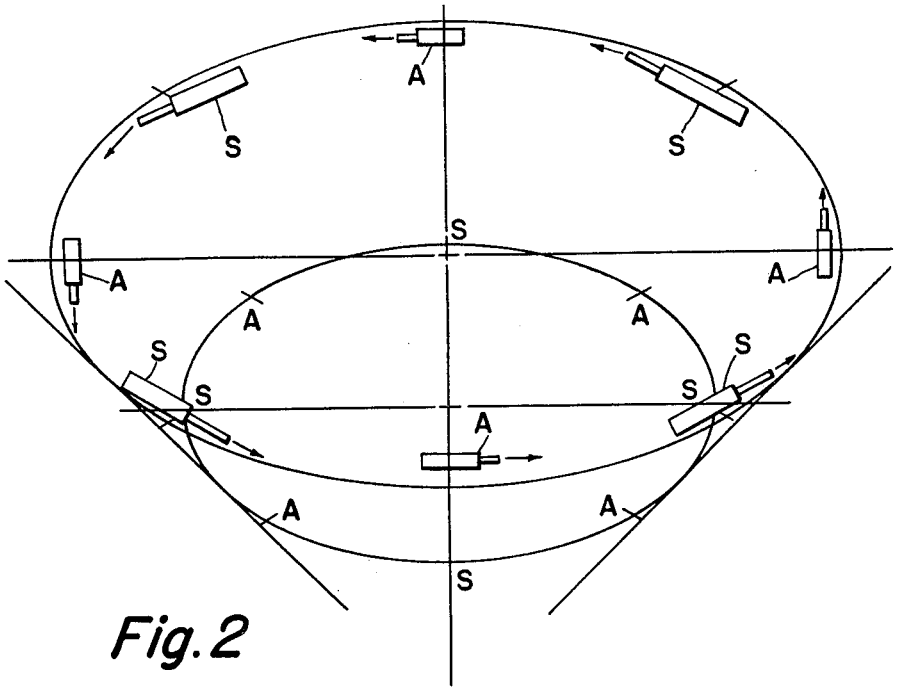
FIG. 2 is a schematic view of the discharge end of the furnace showing air and steam inlet means.
Figure 3:
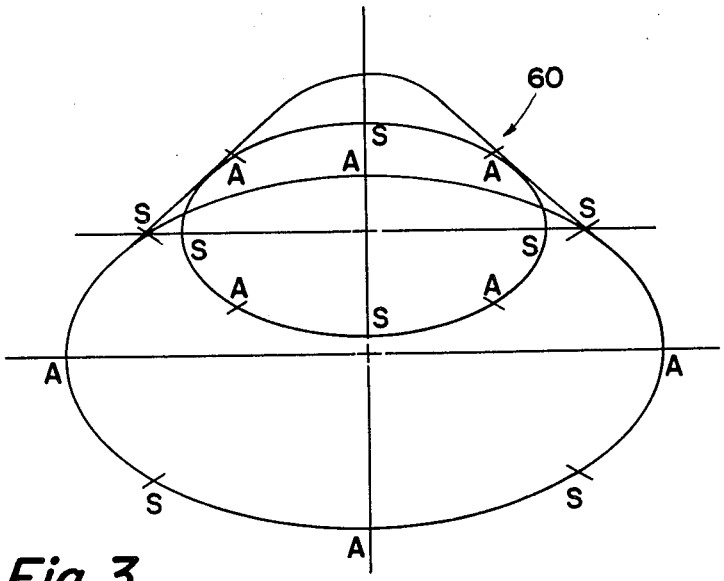
FIG. 3 is a schematic view showing air and steam inlet placement on a metal cone located in the discharge end of the furnace.

The stream inlet means and air inlet means are located on at least one circle within a plane perpendicular to the axis of the furnace and centered about the axis of the furnace within the discharge end of the furnace. Where steam and air inlet means are located on more than one circle, the various circles are of different diameters in different planes perpendicular to the furnace axis and within the discharge end 41. The preferred embodiments have two circles with four to twelve air ports and four to twelve steam ports on each circle. The steam ports and air ports alternate and are equally spaced in each circle. The air ports and steam ports are directed to feed cocurrently in a direction which is tangential to the circle. This spaced relation of steam and air inlets has been found to achieve complete and immediate mixture of air and steam uniformly within the charge bed. FIGS. 2 and 3 show two possible embodiments of placement of air and steam inlet means. A denotes air inlet and S denotes steam inlet.

In the preferred embodiment of the present invention, the steam inlet means into the furnace comprises a plurality of steam ports 44 located within the conical section 42 on at least one plane perpendicular to the axis of the furnace and preferably at equal distances from each other. The steam ports are directed to feed steam tangentially to the circle formed by the plane and furnace wall. On the plane on which the steam ports are located, each air inlet means such as air ports 45 is centered between two corresponding steam ports 31. The air ports are directed to feed air tangentially to the circle formed by the plane and furnace wall. Should additional air ports or steam ports be necessary, they may be provided on two or more planes within the conical section with each plane containing not less than four nor more than twelve steam ports and corresponding air ports. The air ports 45 can be the same inlets through which fuel is fed into the furnace, i.e. the startup burners 46. The schematic placement of air ports 45 and steam ports 31 of this preferred embodiment is shown in FIG. 2

An alternate embodiment is a metal alloy upright cone 60 with it apex directed toward the furnace entrance placed in the bottom of the furnace with its axis approximately along the axis of the furnace. A schematic diagram of the placement of air and steam inlet means in this embodiment is shown in FIG. 3. Air and steam are discharged along the surface of the upright cone for immediate mixture and uniform distribution across the furnace cross-section. The steam inlet means into the furnace comprises a plurality of steam ports located upon the cone surface in at least one plane perpendicular to the axis of the cone and at equal distances from each other. The steam ports are directed to feed steam tangentially to a circle formed by the plane and cone surface. Preferably, the air inlet means into the furnace comprises a plurality of air ports located upon the cone surface in at least one plane perpendicular to the axis of the cone on which the steam ports are located, with each air port centered between two steam ports. The air ports are directed to feed air tangentially to the circle formed by the plane and the cone surface. Of course, the cone 60 can be used in a furnace having additional steam and air inlet means located on the conical section 42 of the furnace discharge end 41 as shown in FIG. 2 and described above.

It is important that the air and the steam be fed into the lower part of the furnace uniformly with respect to each other and uniformly across the furnace cross-section perpendicular to the longitudinal axis of the furnace. Preferably, this is accomplished by the air and steam inlet ports shown in FIGS. 1, 2 and 3, and described above.

Discharge Portion

The discharge exit 25 opens to the sealed discharge portion 9 which comprises an ash hopper 27 which can have a movable pull plate 28 as a base. The ash hopper 27 is sealably connected to the furnace and can open to an ash collection hopper 30 from which the ash is removed by a conveying means such as a screw conveyor 31. The discharge portion 9 is sealed from the ambient atmosphere.

In the vertical furnace of the present invention, the charge is transported through the furnace by gravity and the ash is discharged through the discharge exit 25. The ash within the ash hopper 27 can be used as a means of supporting the charge bed within the furnace chamber 22. When the ash discharges from the discharge exit 25, it falls into the ash hopper 27 and onto the base 29 of the ash hopper 27. The height, length and width of the ash hopper are designed to allow a repose angle alpha ($\alpha$) of the ash bed necessary for the support of the charge bed 47 in the furnace by the ash bed. The repose angle is defined as the angle between a plane through the base 29 of the ash hopper 27 and the ash bed 48 (see FIG. 1). The ash will continue to discharge from the furnace chamber 22 until the repose angle alpha reaches a critical minimum valve. The critical minimum angle of repose is dependent on the material in the charge bed and ash type in addition to ash hopper 27 geometry. Considering these factors, the critical minimum angle of repose is empirically determined. Therefore, the ash hopper 27 is designed so that dimensions W, the width, and L, the length (not shown) of the ash hopper 27 cooperate with the height H to permit the ash bed 47 to have the minimum critical angle of repose necessary for supporting the charge bed 47 of a particular material type within the furnace chamber 22.

The base of the ash hopper 27 is a pull plate 28 which is movable by a suitable means, such as a hydraulic piston 50. The pull plate 28 can be pulled in and out in a shaking fashion underneath the ash bed 47 thus allowing the ash to move horizontally on pull plate 28 and fall into ash collection hopper 30 below. Screen 32 can be placed between the ash hopper 27 and collection hopper 30 to remove large pieces of ash or debris.

The pull plate 50 will shake in response to a signal from a means which measures the level of the charge bed located in the furnace chamber. When the level is too high, the pull plate will shake so that ash falls from the ash hopper 27 through a discharge port to the ash collection hopper 30. Ash then falls from the furnace to the ash hopper 27 and the charge bed level lowers. When the level is sufficiently low, the pull plate 50 is signalled to stop shaking and ash continues to fall from the furnace until a critical angle of repose is reached. The whole ash hopper system, that is, the ash hopper 27 and the ash collection hopper 30 is sealable from the ambient atmosphere. A screw conveyor 31 removes the ash from the collection hopper 30.

METHOD OF OPERATION AND DESIGN

The basic method of operating the furnace of the present invention is to feed the charge by a suitable means into the charge entrance 12. When there is no feed, the entrance gate 34 can be closed to effect a seal of the furnace from the ambient atmosphere. The feed moves from the charge entrance into the hopper where it resides. Should the charge bridge above the rollers it would not feed down into the furnace chamber 22. The hopper is provided with a movable wall 35 which can shake the charge to prevent bridging within the hopper above the rollers 15. Between the hopper and the furnace chamber 22 there is a set of rollers 15 and the furnace entrance 23. The rollers 15 rotate in opposite directions, one clockwise and one counterclockwise so that at the bite between the rollers 15 they are moving toward the direction of the furnace chamber 22 and from the direction of the hopper 14. Preferably at least one of the rollers 15 is driven. The driving rollers 15 pull the charge from the hopper 14 and feed it toward the furnace chamber 22 through the furnace entrance 23.

The feed rate of the charge into the furnace is preset depending upon the composition of the charge and furnace operating conditions. The level of the charge in the charge hopper 14 is continually monitored by the level detectors 39 and 40. The level detectors send a signal to the rollers 15 to either speed them up or slow them down depending on whether more or less charge is required to maintain the desired level. When the level is too high, the rollers speed up and when it is too low the rollers slow down. The distance between the rollers 15 can be varied depending on the type of charge, the desired amount of compression of the charge between the rollers 15 and the desired feed rate. When the charge is pulled through from the hopper 14 toward the furnace chamber 22 from between the rollers 15, it can be compressed depending on how close the rollers 15 are to each other. By compressing the charge through the rollers, an additional seal between the furnace chamber 22 and the ambient atmosphere is provided. The charge can be compressed into a desired density as may be determined depending upon the distance between the rollers 15 and the density of the charge that is being fed into the charge entrance. Thus, the charge is fed into the furnace chamber 22 and the furnace sealed from the ambient atmosphere.

Between the rollers 15 and the furnace chamber 22 is the furnace entrance 23 which has a suitable sealing means such as a sliding gate or at least one trapdoor 17 with preferably two trapdoors. During the operation, the trapdoors 17 are generally kept open. Should the furnace not call for charge, the trapdoors 17 can be closed to prevent the rolls from being heated by the radiant heat of the mass within the furnace and to prevent a loss of the seal between the furnace and the ambient atmosphere.

The charge is fed into furnace chamber 22 and resides in the charge bed 47. The charge bed 47 extends from where the charge is received from the feed portion to the discharge exit 25 of the furnace chamber 22. In the preferred embodiment of the present method, the furnace is operated so that at least two zones are present in the charge bed 47, a volatilization zone 53 and a char reaction zone 54. The volatilization zone 53 is where volatilization of light hydrocarbons take place. This volatilization zone is adjacent to the char reaction zone 54 and between the char reaction zone 54 and the charge entrance 12. The char reaction zone 54 is where the charge is reacted. This zone is adjacent to the volatilization zone 53 and between the volatilization zone 53 and the discharge exit 25. By having these two zones within the same gasification furnace, two processes are used which seem to be incompatible but by careful control of the air and steam being admitted into the conical section 42 of the furnace, these two zones can coexist under desired conditions.

Light hydrocarbons are pyrolyzed off from the volatilization zone and leave the furnace through fume outlet 20. The volatilization zone contains highly combustible gases which when combined with sufficient quantities of oxygen at the proper temperature would result in combustion and possibly explosion. There should be no more than about 5% oxygen in the volatilization zone. Adjacent to this zone is the char reaction zone 54 in which there is steam and air. The amounts of steam and air within the char reaction zone 54 must be carefully controlled to control the endothermic and exothermic reactions taking place in that zone. The exothermic combustion reaction of the oxygen and waste results in a heat release while the endothermic water-gas reaction results in the use of heat. The amount of oxygen fed into the char reaction zone 54 must be controlled to control combustion and to insure that only controlled amounts of oxygen or no oxygen at all are permitted into the volatilization zone 53. Hydrogen and carbon monoxide produced in the water-gas reaction leave the furnace with the flue gas. For the most part they do not oxidize because of the controlled amounts of air in the char reaction zone.

During the operation, a zone can form between the charge entrance 12 and the volatilization zone 53. This is the drying zone 55 in which water from the charge bed evaporates. The water leaves the furnace from the fume outlet 20 with the fumes from the combustion and volatilization occurring within the furnace chamber 22. Finally, there is an ash zone 56 adjacent to the char reaction zone 54 and between the char reaction zone 54 and the discharge exit 25.

Steam and air are fed by suitable steam inlet means and air inlet means into the ash zone 56. The steam ports 44 are within the ash zone 56 near the char reaction zone 54 as are the air inlet ports 45. As the air ascends through the ash zone 56, it cools the ash as the ash progressively moves towards the discharge exit. The air itself is heated by the hot ash as it ascends through the ash zone 56 countercurrent to the ash.

The weight of the charge having a known heat value is measured as it enters the furnace. Knowing the heat value of the waste in Btu's per pounds and the number of pounds of waste per hour, the amount of heat per unit time and Btu's per hour during the reaction of the waste can be determined. The amount of air necessary to react the fixed carbon fraction of a given amount of charge in the char reaction zone can also be determined and can be preset.

Steam is added as a means of cooling the char reaction zone being reacted to produce carbon monoxide and hydrogen in the water gas shift reaction. The water gas shift reaction is endothermic and, therefore, the addition of the steam helps to moderate the temperature in the char reaction zone. Additionally, the ash moving down through the char reaction zone carries away sensible heat. Different charges result in varying amounts and composition of ash which in turn carries away different amounts of heat. The amount of steam is, therefore, related to the composition of the charge and the cooling potential of the steam. The ratio of air to steam is then determined knowing carbon to ash ratio and can be preset.

The amount of air necessary for gasification of a given amount of charge with a known heat value is determined and a signal sent to a controller which sends a measured steam flow rate to maintain the desired air to steam ratio. The temperature in the char reaction zone 54 is continually measured. The temperature can vary due to variation in the properties of the charge of waste material. As temperature changes are measured the admission of more or less air or steam is controlled. The temperature in the char reaction zone should also be monitored to be held below the ash fusion temperature to avoid melting or clinkering of the ash material through the char reaction zone. For instance, with paper waste the reaction temperature may be allowed to reach approximately 2000° F. without adverse effects with respect to clinkering and/or slagging. However, the reaction temperature when municipal dried sludge is used, must be maintained below 1600° F. to avoid slagging due to the low melting point salts present in the ash.

An example of the preferred method of operation of the present invention is the operation of a continuous gasification furnace in which the four zones are present. The heat value of the charge of waste material in this example is 7400–7500 Btu/lb. The temperature at the top of the drying zone 55 is maintained at 775° F. The temperature at the top of the volatilization zone 53 is measured at about 1000° F. The temperature at the top of the char reaction zone 54 is measured at about 2000° F. The temperature at the top of the ash zone 56 is maintained at about 600° F. Finally, the temperature of the ash at discharge exit 25 is maintained at about 400° F. The air to steam ratio is about 13.5.

The ash is discharged from the furnace chamber through discharge exit 25 and into ash hopper 27 and onto the pull plate 28. The ash collects in the ash hopper 27 until the angle of repose $\alpha$ of the ash in the hopper is at the critical minimum angle of repose. At this time the ash no longer is discharged and the charge bed is supported on the pull plate 28 by the ash itself.

At least one level detector 51 is mounted on the furnace wall 21 within the furnace chamber 22. When the level of the charge bed is above a specified level, the pull plate 50 is signalled to move in and out in a shaking fashion. Ash falls from the pull plate 50, through a discharge port to the ash collection hopper 30 and the angle of repose $\alpha$ increases causing more ash to fall from discharge exit 25 into ash hopper 27. When the level of the bed falls below a specified level, the pull plate 50 stops moving and ash falls until a minimum angle of repose $\alpha$ is achieved and the ash in the ash hopper 27 acts as a stop and support for the charge bed. The ash passes from the ash hopper 27 through a discharge port by pulling the pull plate. Debris can be screened from the ash passing to collection hopper 30.

The furnace of the present invention can be operated with a minimum amount of particulate emission from fume outlet 20. This is accomplished by controlling the flow rate of gases through the charge bed. Only enough combustion air is required to react to the fixed carbon fraction of the waste. By having low flow through velocities, particulate pickup by the gas stream is minimized. Under optimum operating conditions, there will be virtually no particulate emissions.

Modifications, changes, and improvements to the preferred form of the invention herein disclosed, described and illustrated, may occur to those skilled in the art who come to understand the principles and precepts thereof. Accordingly, the scope of the patent to be issued herein should not be limited to the particular embodiment of the invention set forth herein, but rather should be limited by the advance of which the invention has promoted the art.

What is claimed is:

1. A furnace, comprising:

(a) a vertically elongated treatment chamber which is sealable from the ambient atmosphere, the chamber having a vertically uppermost entrance opening through which material, to be treated, is charged to the chamber, and a vertically lowermost exit opening through which treated material is discharged from the chamber;

(b) a pair of rollers positioned vertically above the entrance opening such that material charged to the chamber passes between the rollers, prior to falling, by gravity, into the chamber; and (c) means mounting the rollers for rotation about parallel axes; and (d) means for rotating at least one of the rollers in a direction which feeds material into the chamber;

(e) means for moving at least one of the pair of rollers to and from the other of the pair of rollers;

(f) a charge hopper extending vertically above the the pair of rollers, the hopper directing material charged thereto into the chamber through the entrance opening and between the pair of rollers;

(g) means for reciprocating a wall portion of the hopper to facilitate passage of material through the hopper; and (h) means for sensing material in the hopper and causing correlated rotation of the at least one roller, when the material reaches a certain level in the hopper.

2. The furnace of claim 1, which includes:

(i) a discharge hopper disposed vertically below the exit opening and extending therefrom in a direction opposite the entrance opening, the discharge hopper being dimensioned such that particulate matter entering the discharge hopper from the chamber, accumulates at an angle of repose sufficient for the particulate matter in the discharge hopper to support material in the chamber, the discharge hopper having a discharge opening through which particulate matter exits the hopper;

(j) a cover plate adjacent the discharge opening; and (k) means for reciprocating the cover plate to facilitate the discharge of particulate matter from the discharge opening of the discharge hopper.

3. The furnace of claim 2, which includes:

(l) means for monitoring the level of material in the chamber; and (m) means for causing correlated movement of the cover plate when the material reaches a certain level in the chamber.

4. The furnace of claim 3, wherein the chamber includes:

(I) a generally conical portion adjacent the exit opening and extending therefrom in the direction of the entrance opening, the conical portion defined by a sloping, continuous sidewall; and (II) means in the conical portion for directing alternate streams of two different fluids into the chamber and contact with material therein, from the sloping sidewall of the conical portion, including a plurality of ports equally spaced in a circle around the sloping sidewall, the circle being in a plane perpendicular to the longitudinal axis of the chamber, the ports positioned to direct streams of fluid in said plane of the circle and tangentially of the radius of the circle formed by the intersection of the plane of the ports with the sloping surface of the conical portion of the chamber.

5. The furnace of claim 4, wherein the fluid directing means includes a plurality of ports equally spaced in a circle around the sloping sidewall, the circle being in a plane perpendicular to the longitudinal axis of the chamber, the ports positioned to direct streams of fluid in said plane of the circle and tangentially of the radius of the circle formed by the intersection of the plane of the ports with the sloping surface of the conical portion of the chamber.

6. A furnace, comprising:

(a) a vertically elongated treatment chamber which is sealable from the ambient atmosphere, the chamber having a vertically uppermost entrance opening through which material, to be treated, is charged to the chamber, and a vertically lowermost exit opening through which treated material is discharged from the chamber, the chamber having a generally conical portion adjacent the exit opening and extending vertically therefrom, the conical portion defined by a sloping, continuous inner sidewall of the furnace;

(b) a charge hopper extending from the entrance opening of the chamber in opposed relation to the exit opening, the hopper directing material charged thereto, into the chamber through the entrance opening;

(c) a means for reciprocating at least a portion of the hopper to facilitate passage of material therethrough;

(d) a pair of rollers positioned adjacent the entrance opening of the chamber such that material charged to the chamber through the hopper passes between the rollers;

(e) means mounting the rollers for rotation about parallel axes;

(f) means for rotating at least one of the rollers in a direction which feeds material into the chamber;

(g) means for moving at least one of the pair of rollers to and from the other roller to vary the space therebetween;

(h) means for monitoring material in the charge hopper and causing correlated rotation of the at least one roller, when the material reaches a certain level in the hopper;

(i) means in the conical portion for directing alternate streams of different fluids in the same plane and in the same tangential direction relative to the sloping sidewall of the conical portion, to mix said streams within the chamber for contact with material in the chamber, said means including a plurality of inlet ports equally spaced around the sloping sidewall and positioned to direct streams of fluid in tangential relation to the radius of a circle formed by the intersection of the plane of the ports with the sloping surface of the conical portion of the chamber;

(j) a discharge hopper adjacent the exit opening and extending therefrom in a direction opposite the entrance opening, the discharge hopper being dimensioned such that particulate matter entering the discharge hopper from the chamber, accumulates at an angle of repose sufficient for the particulate matter in the discharge hopper to support material in the chamber, the discharge hopper having a discharge opening through which particulate matter exits the discharge hopper and chamber;

(k) a cover plate adjacent the discharge opening;

(l) means for reciprocating the cover plate to move particulate matter in the hopper through the discharge opening;

(m) means for monitoring the level of material in the chamber; and (n) means for causing correlated reciprocating movement of the cover plate when the material reaches a certain level in the chamber.

7. The furnace of claims 1 or 6, which includes means adjacent the pair of rollers for closing the chamber to material charged to the charge hopper.

* * * * *